US007109875B2

(12) United States Patent
Ota et al.

(10) Patent No.: US 7,109,875 B2
(45) Date of Patent: Sep. 19, 2006

(54) SENSOR NETWORK SYSTEM MANAGING METHOD, SENSOR NETWORK SYSTEM MANAGING PROGRAM, STORAGE MEDIUM CONTAINING SENSOR NETWORK SYSTEM MANAGING PROGRAM, SENSOR NETWORK SYSTEM MANAGING DEVICE, RELAY NETWORK MANAGING METHOD, RELAY NETWORK MANAGING PROGRAM, STORAGE MEDIUM CONTAINING RELAY NETWORK MANAGING PROGRAM, AND RELAY NETWORK MANAGING DEVICE

(75) Inventors: Shunji Ota, Kyoto (JP); Yoshiyuki Otsuki, Kyoto (JP); Masayuki Oyagi, Kyoto (JP); Masaki Yamato, Kyoto (JP)

(73) Assignee: Omron Corporation, Kyoto (JP)

( * ) Notice: Subject to any disclaimer, the term of this patent is extended or adjusted under 35 U.S.C. 154(b) by 270 days.

(21) Appl. No.: 10/491,590

(22) PCT Filed: Oct. 1, 2002

(86) PCT No.: PCT/JP02/10238

§ 371 (c)(1),
(2), (4) Date: Apr. 2, 2004

(87) PCT Pub. No.: WO03/032271

PCT Pub. Date: Apr. 17, 2003

(65) Prior Publication Data

US 2004/0254652 A1 Dec. 16, 2004

(30) Foreign Application Priority Data

Oct. 4, 2001 (JP) ..... 2001-309093

(51) Int. Cl.
*G08B 21/00* (2006.01)

(52) U.S. Cl. ..... 340/635; 340/636.1; 340/636.19; 340/637; 320/132; 320/133; 320/138; 320/155; 324/426; 702/63

(58) Field of Classification Search ..... 340/635, 340/636.1, 636.11, 636.12, 636.13, 636.15, 340/636.19, 637, 660, 661; 320/127, 128, 320/132, 133, 136–138, 155; 324/426, 433, 324/434, 522; 702/63, 64, 79; 700/291, 700/295, 297

See application file for complete search history.

(56) References Cited

U.S. PATENT DOCUMENTS 5,686,896 A * 11/1997 Bergman ..... 340/636.1
5,905,438 A * 5/1999 Weiss et al. ..... 340/636.1
6,317,697 B1 * 11/2001 Yoshikawa et al. ..... 702/63
6,781,514 B1 * 8/2004 Murofushi ..... 340/636.1

FOREIGN PATENT DOCUMENTS

JP 3-220828 A 9/1991
JP 3-289295 A 12/1991

(Continued)

*Primary Examiner*—Davetta W. Goins
(74) *Attorney, Agent, or Firm*—Foley & Lardner LLP

(57) ABSTRACT

In a sensor network system, a communications network connects a set of sensors to a server collectively managing the set of sensors. First, the sensor-managing server acquires remaining drive times of batteries in the sensors, and specifies a target remaining drive time. The server then controls the operation of the sensors so that the remaining drive times of the batteries in the sensors are substantially equal to the target remaining drive time. This reduces the maintenance workload for a system manager, especially, in the recharging of the sensor batteries.

11 Claims, 10 Drawing Sheets

FOREIGN PATENT DOCUMENTS

| | | | |
|---|---|---|---|
| JP | 05-128387 | | 5/1993 |
| JP | 05-284169 | | 10/1993 |
| JP | 6-237318 | A | 8/1994 |
| JP | 07-091986 | | 4/1995 |
| JP | 7-201354 | A | 8/1995 |
| JP | 08-186653 | | 7/1996 |
| JP | 9-8676 | A | 1/1997 |
| JP | 9-149079 | A | 6/1997 |
| JP | 9-153868 | A | 6/1997 |
| JP | 10-143782 | | 5/1998 |
| JP | 2000-261360 | A | 9/2000 |
| JP | 2001-167364 | | 6/2001 |
| JP | 2001-175918 | | 6/2001 |
| JP | 2001-218376 | | 8/2001 |

* cited by examiner

SENSOR NETWORK SYSTEM MANAGING METHOD, SENSOR NETWORK SYSTEM MANAGING PROGRAM, STORAGE MEDIUM CONTAINING SENSOR NETWORK SYSTEM MANAGING PROGRAM, SENSOR NETWORK SYSTEM MANAGING DEVICE, RELAY NETWORK MANAGING METHOD, RELAY NETWORK MANAGING PROGRAM, STORAGE MEDIUM CONTAINING RELAY NETWORK MANAGING PROGRAM, AND RELAY NETWORK MANAGING DEVICE

TECHNICAL FIELD

The present invention relates to sensor network systems in which multiple sensors are connected over a communications network to a server collectively managing the sensors.

BACKGROUND ART

A huge variety of sensors have been used in large numbers in our everyday life for some time. They are specialized for particular purposes including detection of car thefts, house break-ins, and fires. These sensors typically make up sensor networks for individual purposes. A sensor network system made up of these sensor networks is capable of collectively managing various kinds of sensor information.

Each sensor network has a sensor network controller connected to the sensors by a wired or wireless communicable link. Therefore, results of detection by sensors and other sensor information are communicated by the sensor network controller.

In addition, the sensor network system has a server computer ("server") which collectively manages information from the sensor networks. The server has communicable connections with the sensor network controllers of the sensor networks so that the server can acquire sensor-originated information via the sensor network controllers. Also, the server is capable of controlling operation of the sensors.

Many sensor networks cover a large geographic area. The server is therefore connected to the sensor network controllers over a communications infrastructure providing long distance communications. An example of such communications infrastructure is a relay network interconnecting multiple relays.

In sensor network systems like this one, sensors are installed at various places. Some sensors need to be installed where they cannot rely on an external power supply, in which case the sensor should operate from a battery.

If one of battery-driven sensors in a system runs out of battery power, a maintenance work is required to recharge the sensor. The sensors vary in battery capacity and power consumption, therefore running out of battery power at different times from sensor to sensor. Under these circumstances, the batteries must be frequently recharged, which adds to the maintenance workload for the sensor network system manager.

Data travels via vastly differing routes in a relay network, depending on the positional relationship of the server and the sensor network controllers transferring the data to and from the server. Besides, each relay is communicable with one or more relays; data can travel between the server and a given sensor network controller via various routes.

In such systems, a particular relay may be used extremely frequently, depending on how the communications route is selected. If the relay is driven by a battery, it quickly consumes battery power and calls for frequent recharging of the battery. This means added frequency of maintenance recharging and an added workload for the sensor network system manager. Another problem is that an extremely frequent use of a relay shortens the service life of the relay and its battery.

The present invention, made to address these issues, has an objective to offer a sensor network system managing method and a relay network managing method which, in a sensor network system in which multiple sensors are connected over a relay network or other communications network to a server collectively managing the sensors, reduce the maintenance workload for the system manager, especially, in the recharging of sensor and relay batteries.

DISCLOSURE OF INVENTION

To solve the problems, a sensor network system managing method in accordance with the present invention is implemented by a sensor network system managing device, communicable with sensors, which receives sensor information from the sensors and controls operation of the sensors, and characterized by involving the steps of:

acquiring remaining drive times of batteries in the sensors;

specifying a target remaining drive time; and controlling the operation of the sensors so that the remaining drive times of the batteries in the sensors are substantially equal to the target remaining drive time.

According to the method, the operation of the sensors is controlled so that the remaining drive times of the batteries in the sensors are substantially equal to the target remaining drive time. Under such control, most battery-driven sensors in the sensor network system run out of power at substantially the same time. This enables recharging of many sensor batteries in a single round of recharge maintenance work, thereby greatly reducing recharge frequency. Therefore, a manager managing the sensor network system is relieved of some of the maintenance workloads.

A relay network managing method in accordance with the present invention communicably links communication terminals with each other through relays interconnected in a communicable manner, and is characterized by comprising:

acquiring selectable relay routes when two specific communication terminals communicate with each other;

acquiring information on remaining battery power of relays located on the selectable relay routes;

identifying a relay, for each relay route, which has a minimum remaining battery power on that relay route;

selecting one of the relay routes on which is located a relay with a maximum remaining battery power among those relays which have a minimum remaining battery power on the individual relay routes; and specifying as a relay route for a signal transmission/reception between the two specific communication terminals.

According to the method, when communications is started between two specific communication terminals, first, selectable relay routes are selected. Here, there are one or more candidates for the relay route. Thereafter, a relay which has a minimum remaining battery power is identified for each selected relay route. A relay route on which is located a relay with a maximum remaining battery power among those identified is specified as the relay route for the communications. In other words, the relay route is selected from those with relays with large remaining battery power. Therefore, the remaining battery powers of the relays decrease equally. An inconvenience is prevented from happening where particular relays were so frequently used that they could quickly run out of battery and require frequent recharging. The system manager is relieved of some of the workloads. The method solves another inconvenience that an extremely frequent use of particular relays shortens the service life of the relays and their batteries.

Additional objects, advantages and novel features of the invention will be set forth in part in the description which follows, and in part will become apparent to those skilled in the art upon examination of the following or may be learned by practice of the invention.

BEST MODE FOR CARRYING OUT THE INVENTION

EMBODIMENT 1

Referring to FIG. 1 through FIG. 7, the following will describe an embodiment in accordance with the present invention.

(Overall Structure)

Figure 2:
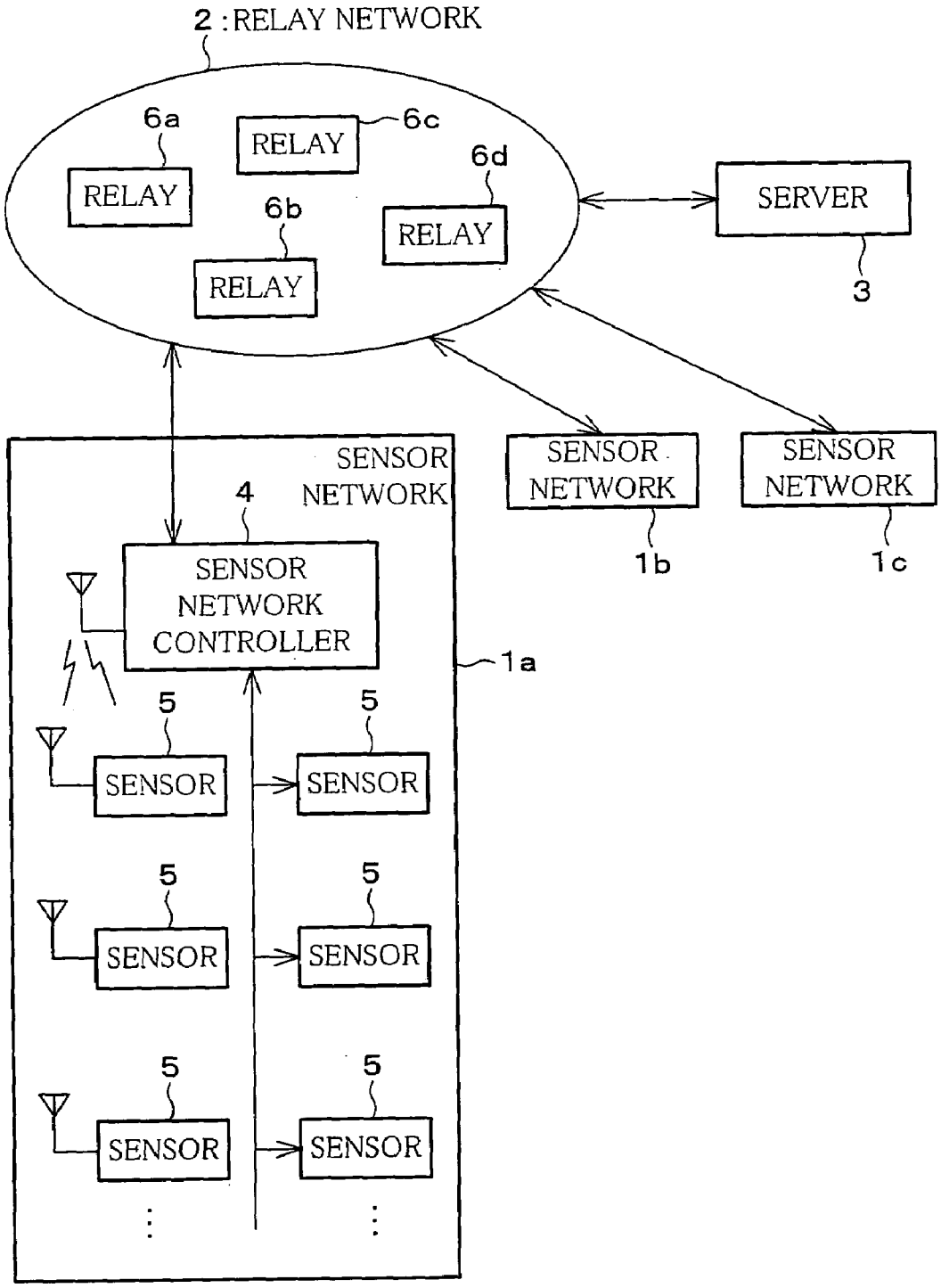
FIG. 2 is a schematic block diagram illustrating a configuration of the sensor network system.

FIG. 2 is a block diagram schematic illustrating a configuration of a sensor network system in accordance with the present embodiment. The sensor network system includes sensor networks 1*a*, 1*b*, 1*c*, a relay network 2, and a server (sensor network system managing device or relay network managing device) 3.

Each sensor network 1*a*, 1*b*, 1*c* includes a sensor network controller 4 and a set of sensors 5. FIG. 2 depicts an internal structure only for the sensor network 1*a*; the sensor networks 1*b*, 1*c* have a similar structure. In the following, a given one of the sensor networks 1*a*, 1*b*, 1*c* will be referred to as the "sensor network 1" when there is no need to discriminate between the networks 1*a*, 1*b*, 1*c*.

The relay network 2 includes a set of relays 6*a*, 6*b*, 6*c*, 6*d*. Each relay is capable of wireless communications with others. Here, as to the range of wireless communications, each relay is not necessarily communicable with all relays on the relay network 2, but should only communicable with one or more other relays. Each relay is not necessarily capable of wireless communications, but the system may partly involve wired communications. Connected in the foregoing manner to form a network, the set of relays 6*a*, 6*b*, 6*c*, 6*d* can make up a relay network covering a large geographic area even when a given communications device has a small communications range. In the following, a given one of the relays 6*a*, 6*b*, 6*c*, 6*d* will be referred to as the "relay 6" when there is no need to discriminate between the relays 6*a*, 6*b*, 6*c*, 6*d*.

The server 3 is the central block of the sensor network system. The server 3 is capable of single-handedly managing sensor information from the sensor networks 1 to detect any occurrence of an inconvenience in the sensor network system. The server 3 is connected for communication with a particular one of the relays 6 on the relay network 2, thus being capable of communications via the relay network 2. The server 3 and the relay 6 may be connected using any technique, wireless or wired.

The sensor network 1, as mentioned previously, includes the single sensor network controller 4 and the multiple sensors 5 capable of data communication with the sensor network controller 4. Now, a data communications scheme will be explained between the sensor network controller 4 and the sensors 5. The sensor network controller 4 and the sensors 5 are fitted with respective communications devices. The communications device for the sensor network controller 4 is the host, whereas the communications devices for the sensors 5 are terminals. Data communications is performed between the host and the terminals.

The data communications between the host and terminals may be wired or wireless. Some examples for the latter utilize a short-distance wireless system based on weak radio waves as in wireless LAN (Local Area Network) standards and Bluetooth (registered trademark) standards or a specified small power wireless system. Others utilize an optical wireless system or short-distance infrared communications system. Wired communications may be based on a LAN or utilize dedicated lines.

The communications between the host and terminals may be bidirectional or single-directional, depending on the type of the sensors 5. The communications are bidirectional if the sensors 5 are controlled by the sensor network controller 4 through control signals. Meanwhile, the communications are terminal-to-host single-directional if the sensors 5 send signals to the sensor network controller 4, with no signals traveling in the opposite direction.

In the sensor 5, the interface between the sensor section for sensing and the communications devices (terminals) can be, for example, RS-232C, RS-485, or DeviceNET. It is through this interface that the sensors 5 sends an analog current/voltage or pulse signal indicating a result of sensing by the sensor sections to the sensor network controller 4 after the signal is converted to digital in a D/A converter.

The sensor network controller 4 receives signals from the sensors 5 and pass them on to the server 3 via the relay network 2. The sensor network controller 4 is communicably connected to a particular one of the relays 6 on the relay network 2, thus being capable of communications via the relay network 2. The sensor network controller 4 and the relay 6 may be connected using any technique, wireless or wired.

Next, the configuration of the sensor network 1 will be described. The single sensor network controller 4 typically manages two or more sensors 5 (for example, a maximum of 256 sensors 5 or about 10 sensors 5 in a security management sensor network 3) which make up a sensor network 1. Sensor networks 1 may overlap as shown in FIG. 3.

Figure 3:
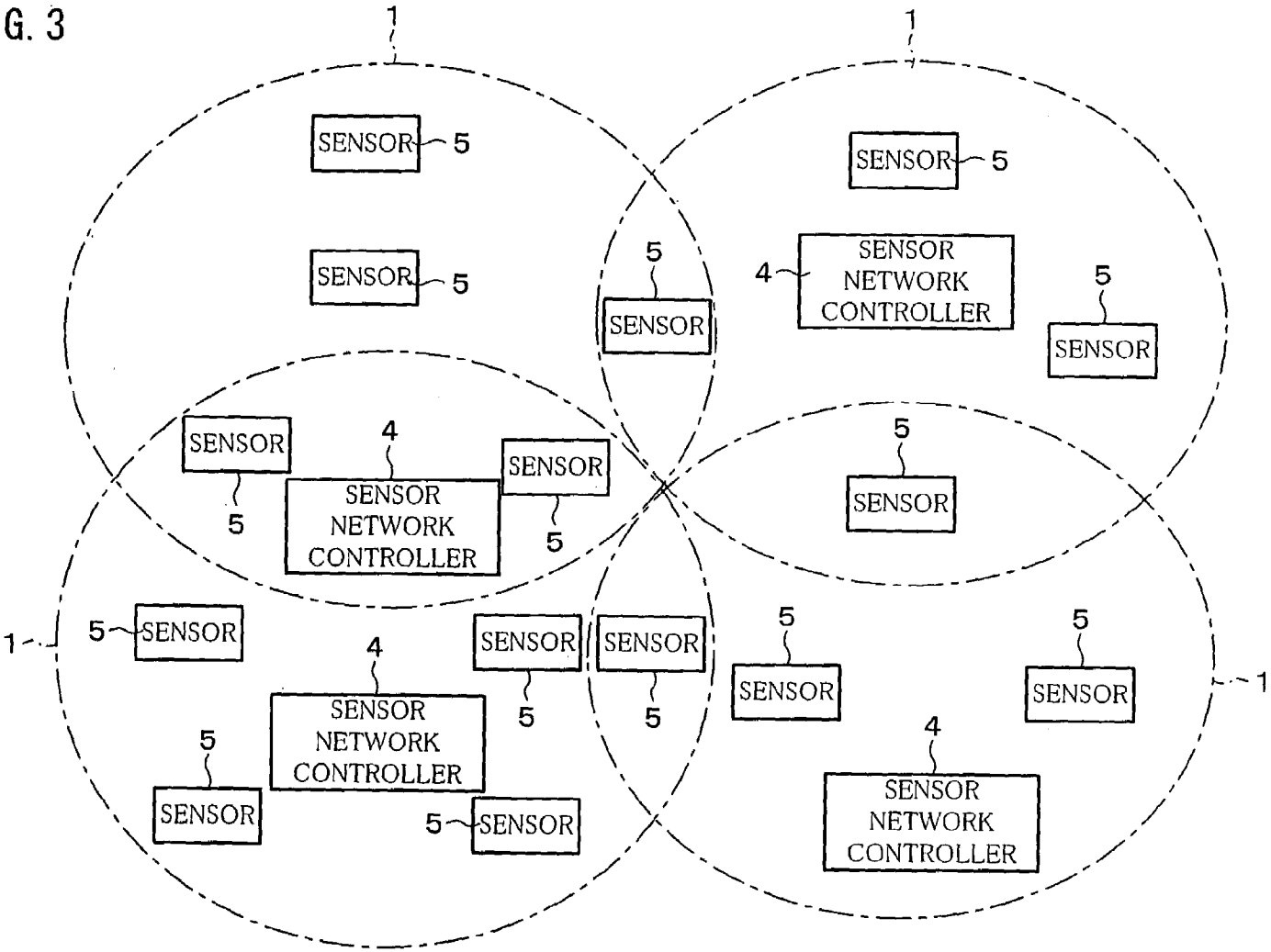
FIG. 3 is a schematic drawing showing an example of overlapping sensor networks.

FIG. 3 is a schematic drawing showing an example of overlapping sensor networks 3. In the FIG. 3 example, some sensors 5 are on more than one sensor networks 1, and there are two sensor network controller 4 in a sensor network 1. If a sensor 5 is managed by two or more sensor network controllers 4 as in this ex maple, a breakdown or other trouble of one of the sensor network controllers 4 does not affect the normal operation of the sensor 5, with another sensor network controller 4 taking over the managing duty. Therefore, it is desirable if sensors 5 with which a high level of reliability is required should be managed by two or more sensor network controllers 4 as in this example.

In the FIG. 2 system, each sensor 5 is identified by a unique sensor ID assigned to that sensor 5. The use of large quantities of sensors 5 in a sensor network enables various kinds of sensing. The increased amount of available information helps see the situation from various perspectives. To use many sensors 5, the sensor ID should be of an increased bit (for example, 64 bits or higher).

(Sensor)

Various types of sensors can be used as the sensors 5 on the sensor network 1. Examples follow.

Those detecting a human include photoelectric sensors, beam sensors, ultrasound sensors, and infrared sensors. Those detecting a movement or destruction of an object include vibration sensors and acceleration sensors (3D sensors, ball semiconductor sensors). Those detecting a sound include microphones, pitch sensors, and acoustic sensors. Those detecting video include video cameras. Those detecting fires include temperature sensors, smoke sensors, and humidity sensors. Those primarily mounted to vehicles include GPS (Global Positioning System) devices, acceleration sensors, wiper ON/OFF sensors, vibration sensors, and tilt sensors. Those installed indoors include light ON/OFF sensors and water leak sensors. Those installed outdoors include rain gauges, wind gauges, and thermometers. There are various other sensors: namely, capacitance level sensors, capacitive intrusion sensors, electric current sensors, voltage sensors, door opening/closure detecting reed switches, and time detecting clocks.

As discussed in the foregoing, the sensors 5 on the sensor network 1 are not limited to devices generally called "sensors." The sensors 5 may be any kind of device which detects an event and for example, converts a sensing result into an electric signal for transfer to the sensor network controller 4.

Some of the sensors 5 on the sensor network 1 may be active sensors. The active sensor refers to a device which is capable of change its sensing functionality in accordance with a change in situation. A video camera is an example of the active sensor. The active video camera sensor has zooming and autofocusing functions and a direction-changing function to change the shooting direction, as well as CCDs (Charge Coupled Device) as a sensor section for performing sensing, and automatically operates under the control of the sensor network controller 4 by means of control signals. Such active sensors are capable of relatively high precision sensing suitable to the events. For example, the video camera, upon detection of a moving object (smoke, for example) in its shooting range, points itself at the object to shoot it more appropriately.

Some of the sensors 5 on the sensor network 1 may be autonomous. The autonomous sensor here refers to a sensor which notifies the server 3 via the sensor network controller 4 of information on the sensor itself (sensor information) and sensing results, for example, periodically. The sensor information indicates, for example, the type(s) (including their detection target) and layout (positions) of the sensor.

In some cases, the sensors are attached to movable objects like vehicles. Moving a sensor may change the information obtained from a sensing result given by the sensor. Take, for example, a thermometer mounted to a vehicle as an air temperature sensor; sensing results represent air temperatures at different places depending on the position of the vehicle, hence, of the sensor. Using an autonomous sensor in such situations makes it possible to continuously keep track of where the sensor is sensing air temperature.

Normally, the types of sensors 5 are selected for specific purposes: for example, detection of car thefts, house break-ins, or fires. The sensors 5 are installed at places suitable for those purposes. Generally, the sensors 5 form sensor networks 1 for individual purposes with the server 3 handling monitoring, notification, and other processes to achieve the objective.

The sensors 5 can be divided into three major types as to methods of reporting a sensing result, that is, how they transfer sensing data to the sensor network controller 4: cyclic, event-responsive, and polling. A cyclic sensor conveys a sensing result at a predetermined time cycle. An event-responsive sensor conveys a sensing result when it has detected a predetermined event, for example, when it has detected a physical quantity greater than or equal to a predetermined threshold value. A polling sensor conveys a sensing result when instructed to do so by the sensor network controller 4.

Some of the sensors 5 run on a external power supply, and the others run on a built-in battery with no external power supply. Here, those running on a battery will be referred to as the battery-driven sensors 5. Generally, the sensors 5 may be installed anywhere including, when the need arises, places where it is difficult to find an external power supply. This is where a battery-driven sensor 5 comes into use.

Supposedly, the battery-driven sensor 5 sends information on the remaining battery power, as well as results of sensing, to the sensor network controller 4. Examples of information on remaining battery power include a remaining drive time, recharge ratio, and battery output voltage. Which pieces of information will be sent is decided based on the ability of battery control means in the battery-driven sensor 5. To construct the battery-driven sensor 5 at a minimum cost, the sensor 5 preferably has such a construction that a measurement of the battery output voltage is directly output. In the present embodiment, the battery-driven sensor 5 outputs a measurement of the battery output voltage to the sensor network controller 4 as the battery information.

(Sensor Network Controller)

Figure 4:
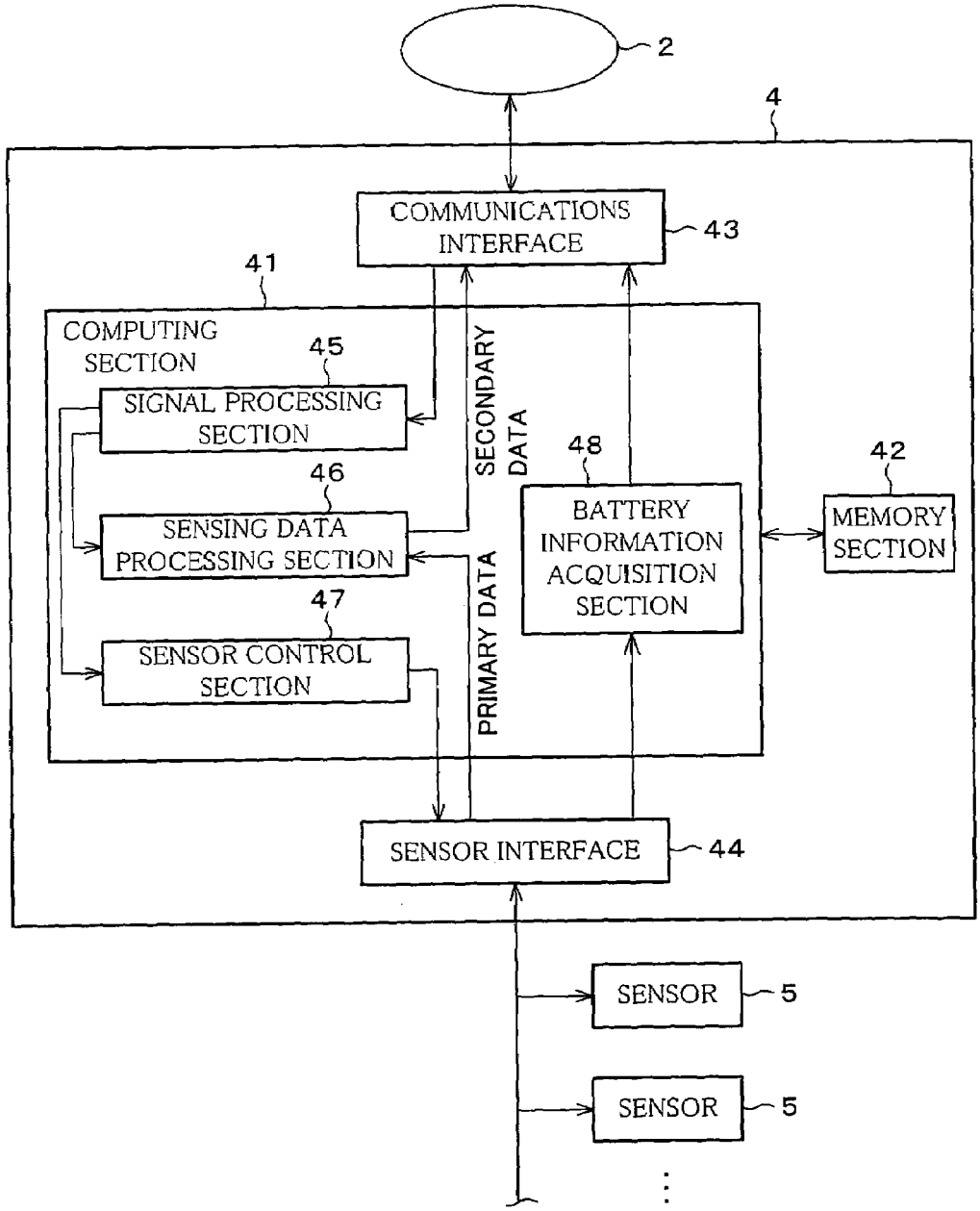
FIG. 4 is a block diagram illustrating an internal structure of a sensor network controller.

FIG. 4 is a block diagram illustrating an internal structure of the sensor network controller 4. The sensor network controller 4 includes a computing section 41 executing various computing, a memory section 42 storing various data, a communications interface 43 providing an interface to the relay network 2, and a sensor interface 44 providing an interface to the sensors 5.

The computing section 41 is arranged from a computing circuit, for example, a microcomputer so that on the basis of its computing functionality, it can execute various data processing and make instructions to various control circuits.

Hence, the computing section 41 exerts control on the entire sensor network controller 4. The computing section 41, owing to its computing functionality, embodies the following function blocks: a signal processing section 45, a sensing data processing section 46, a sensor control section 47, and a battery information acquisition section 48. These function blocks are embodied, for example, when a computer program embodying the functionality is executed by a microcomputer.

The signal processing section 45 controls sensing data processing in the sensing data processing section 46 and sensor control processing in the sensor control section 47 on the basis of control signal sent from the server 3 via the relay network 2 and the communications interface 43.

The sensing data processing section 46 executes predetermined processes on sensing data (primary data), as sensing results, sent from the sensors 5 via the sensor interface 44 where necessary and sends the processed sensing data (secondary data) to the server 3 via the communications interface 43 and the relay network 2.

The sensing data processing section 46 may store the secondary data in the memory section 42 and transfer the secondary data to the server 3 when requested to do so.

The processes executed on the sensing data by the sensing data processing section 46 are controlled by the signal processing section 45. As a result, out of the sensing data provided by the sensors 5, only useful sensing data is sent to the server 3, which contributes to reduction in amount of the data sent to the server 3.

For example, primary data from a video camera as a sensor 5, that is, image data, may in some cases transferred continuously at a rate of 20 to 30 Kbits/screen and 3 screens/second. In the sensing data processing section 46, the primary data is thinned down by removing images with small changes in order to produce useful and small secondary data.

The sensor control section 47 controls the sensors 5 by sending control signals to the sensors 5 via the sensor interface 44. Exemplary controls of the sensors 5 are the control of a transmission cycle of sensing data for cyclic sensors; the control of a threshold value for event-responsive sensors; polling control for polling sensors; and operate control of active sensors. The control of the sensors 5 by the sensor control section 47 is based on instructions from the signal processing section 45.

The battery information acquisition section 48 is a block acquiring battery information which is transferred from the battery-driven sensors 5 and received through the sensor interface 44. The acquired battery information is stored in the temporarily memory section 42 before transmitted to the server 3 through the communications interface 43 and the relay network 2.

The memory section 42 stores various computer programs and data for various processing in the computing section 41 and is embodied by, for example, a flash EEPROM.

(Server)

Figure 5:
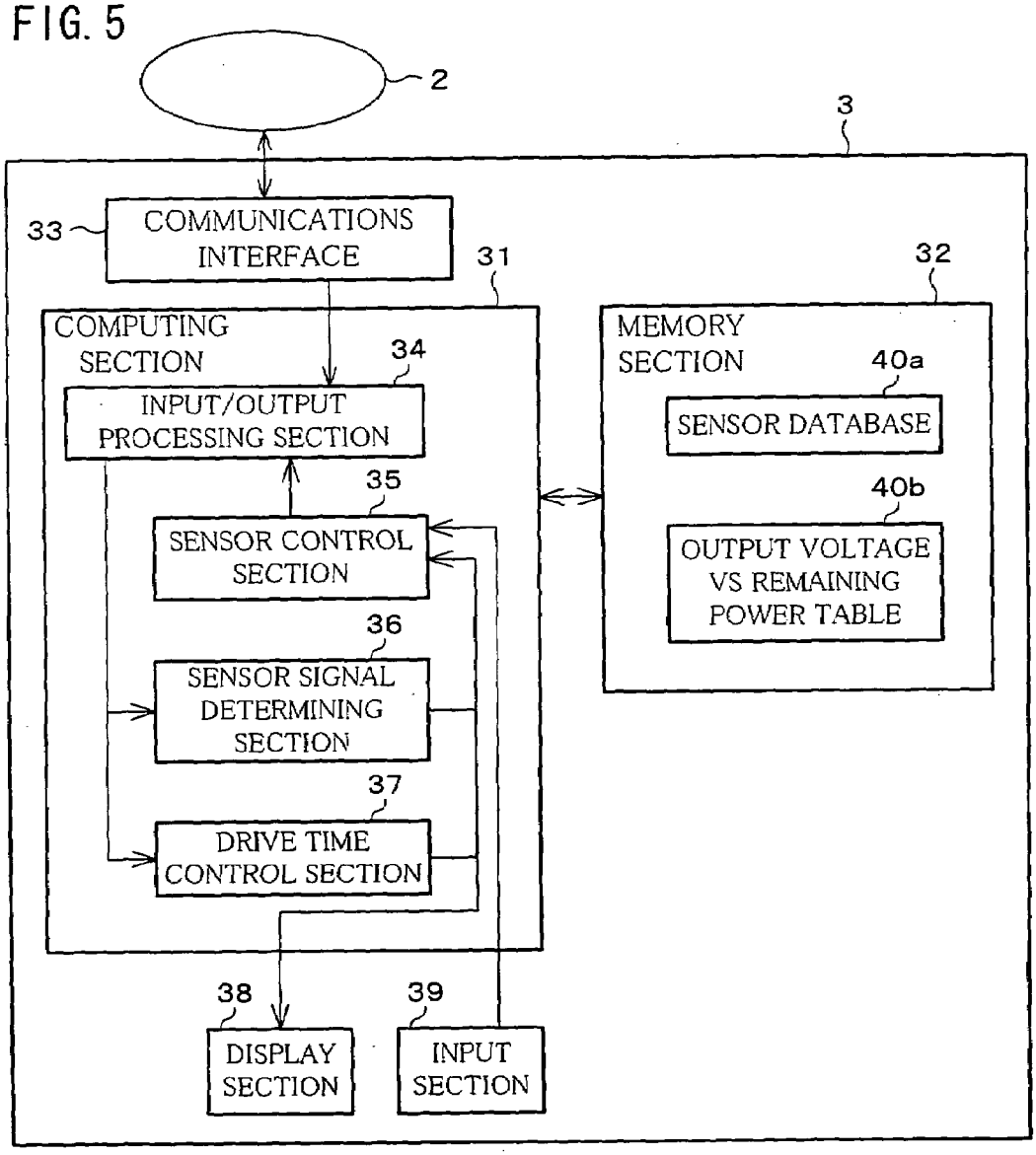
FIG. 5 is a schematic block diagram illustrating a configuration of a server.

FIG. 5 is a schematic block diagram illustrating a configuration of the server 3. The server 3 is a computer installed at a monitor center in the sensor network system. The server 3 monitors sensor outputs from all the sensors 5 in the sensor network system, manages the remaining battery power of the sensors 5, and controls the operation of the sensors 5.

The server 3 includes: a communications interface 33 providing an interface to the relay network 2, a computing section 31 executing various computing, and a memory section 32 containing various data related to the sensors 5. Also, the server 3 is fitted with a display section 38 producing a display of, for example, the situation being monitored to the operator and an input section 39 receiving various inputs from the operator.

The computing section 31 is arranged from a computing circuit, for example, a microcomputer so that on the basis of its computing functionality, it can execute various data processing and make instructions to various control circuits. Hence, the computing section 31 exerts control on the entire server 3. The computing section 31, owing to its computing functionality, embodies the following function blocks: an input/output processing section 34, a sensor control section 35, a sensor signal determining section 36, and a drive time control section 37. These function blocks are embodied, for example, when a computer program embodying the functionality is executed by a microcomputer.

The input/output processing section 34 is a block executing processes related to the input/output of various signals from/to the sensors 5 via the sensor network controller 4, the relay network 2, and the communications interface 33.

The sensor signal determining section 36 is a block analyzing sensor signals from the sensors 5, that is, sensing result information from the sensors 5 to determine an occurrence of abnormality. The determine is made on the basis of a sensor database 40*a* stored in the memory section 32. Results of the determination made by the sensor signal determining section 36 are displayed on the display section 38 in a suitable manner.

The drive time control section 37 is a block analyzing battery information from the battery-driven sensors 5 to calculate remaining drive times for the battery-driven sensors 5 and to calculate a control method for the operation of the battery-driven sensors 5 in accordance with the remaining drive times. These processes are carried out on the basis of the sensor database 40*a* and output voltage vs. remaining power tables 40*b* stored in the memory section 32. The processes in the drive time control section 37 will be detailed later. The contents of the processes implemented by the drive time control section 37 are displayed on the display section 38 in a suitable manner.

The sensor control section 35 is a block controlling the operation status of the sensors 5 in the sensor network system. The control of the operation status of the sensors 5 is carried out on the basis of control contents contained in the sensor database 40*a*, results of determination of the sensor signal determining section 36, the control method for the operation status calculated by the drive time control section 37, instruction inputs from the operator of the input section 39, etc. The sensor control section 35 transmits control signals to specified ones of the sensors 5 via the input/output processing section 34 and the communications interface 33.

The memory section 32 is a block containing the sensor database 40*a* and the output voltage vs. remaining power tables 40*b*, as well as various computer programs and data for the computing section 31 to implement various processes. The memory section 32 is embodied by a hard disk drive or like storage device.

Next, the sensor database 40*a* will be described. The sensor database 40*a* is a database containing information related to all the sensors 5 in the sensor network system. The following is examples of information in the sensor database 40*a* related to the sensors 5.

A first example is information on the locations of the sensors 5. More specifically, the information represents the geographical areas where the sensors 5 are installed (place name or latitude/longitude) and their installation schemes (on the ground, in the air, on a wall, height above the ground).

A next example is information on the target of sensing for the sensors 5, in other words, information on the type of the sensors 5. The information indicates the aforementioned types of sensors: for example, temperature sensors- and ultrasound sensors. This kind of information includes the aforementioned sensor classification into active and autonomous categories, as well as cyclic, event-responsive, and polling categories.

A next example is information on the sensor network 1 to which the sensors 5 belong. This information indicates the sensors 5 belong to which sensor network 1 and are under the control of which sensor network controller 4.

A next example is information on conditions under which it is determined whether a result of sensing by the sensors 5 indicates an abnormality. The conditions include, for example, a threshold value beyond which a sensing result is determined to be indicating an abnormality.

A next example is information as to whether the sensors 5 operate from a batter or not. For battery-driven sensors 5, the type of battery used as the battery, an average power consumption by the an sensors 5, and other information are recorded in the sensor database 40*a*.

A next example is information, recorded in the sensor database 40*a*, on the cycle of reporting of sensing results when the sensors 5 are cyclic. For polling sensors 5, information on polling intervals or polling conditions is recorded in the sensor database 40*a*. If the sensors 5 are event-responsive, information on conditions for events triggering a reporting of a sensing result is recorded in the sensor database 40*a*.

These kinds of information is recorded for each sensor 5 in the sensor database 40*a*. It is assumed that the sensors 5 are identifiable by the aforementioned sensor IDs and that the signal sent to the server 3 contains a sensor ID in the header.

Now, processes in the drive time control section 37 will be described. The drive time control section 37, as mentioned previously, calculates remaining drive times on the basis of the battery information from the battery-driven sensors 5 and calculates a control method for the operation status of the battery-driven sensors 5 in accordance with the remaining drive times. These two processes will be described in detail in the following.

The process of calculating an remaining drive time for the battery-driven sensor 5 will be first described. The battery-driven sensor 5, as mentioned earlier, is adapted to transmit a measurement of the battery output voltage as the battery information to the server 3. Based on this battery output voltage, the drive time control section 37 first calculates a remaining battery power. The battery information may be transmitted from the battery-driven sensor 5 to the server 3 automatically and regularly, or in response to a request from the server 3.

Figure 6:
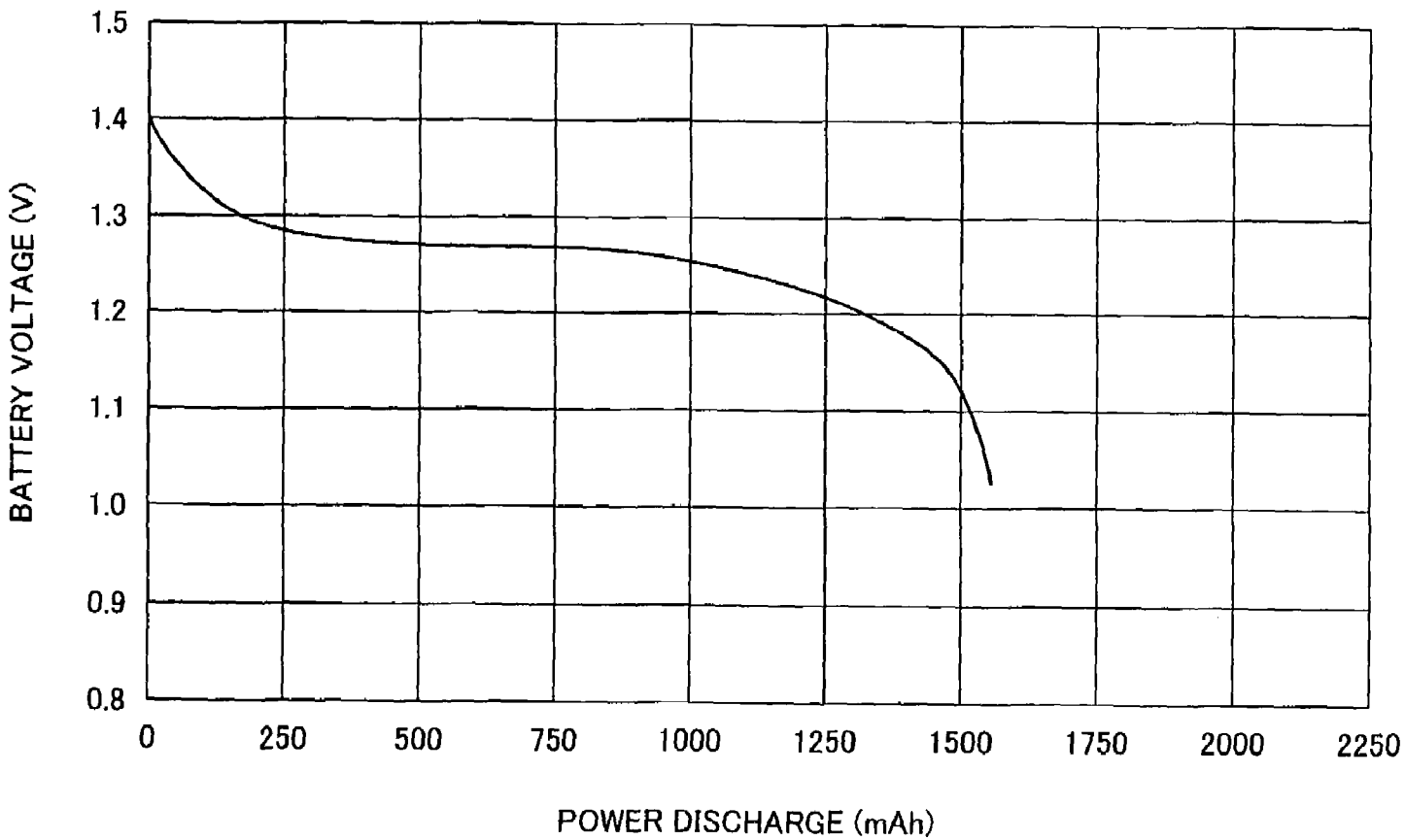
FIG. 6 is a graph representing a relationship between the discharge and voltage of a nickel hydrogen battery which is a secondary battery.

FIG. 6 is a graph representing a relationship between the discharge and battery voltage of a secondary, nickel hydrogen battery which is an example of the battery. As shown in the figure, a secondary battery has a characteristic where the more it discharges, that is, the less the remaining power, the smaller the output voltage. This characteristic is exploitable to estimate the remaining power from the output voltage.

For example, in the case of the nickel hydrogen battery described in FIG. 6, the relationship between the output voltage and the remaining power can be understood from the graph as in the following: When the output voltage is 1.40 V, the remaining power rate is 90%. Supposing a full capacity of 1600 mAh, the remaining power is estimated at 1440 mAh. Similarly, for the output voltage=1.27 V, the remaining power rate is 50%, and the remaining power is estimated at 800 mAh. For the output voltage=1.15 V, the remaining power rate is 10%, and the remaining power is estimated at 160 mAh.

Therefore, first, output voltage vs. remaining power tables 40*b* representing, like the FIG. 6 table, a relationship between the output voltage and the remaining power are recorded in the memory section 32, one for each type of battery used in the sensors 5 in the sensor network system. Referring to these output voltage vs. remaining power tables 40*b*, the drive time control section 37 can provide a knowledge on the remaining power of the sensor 5 from which battery information has been received.

After the check on the remaining power, the remaining drive time is calculated from the remaining power. The average power consumption by the sensor 5 is recorded in the sensor database 40. Therefore, the remaining drive time is given by the equation:

(Remaining Drive Time)=(Remaining Power)/(Average Power Consumption).

The resultant remaining drive time is recorded in an entry for the sensor 5 in the sensor database 40*a*.

Figure 7:
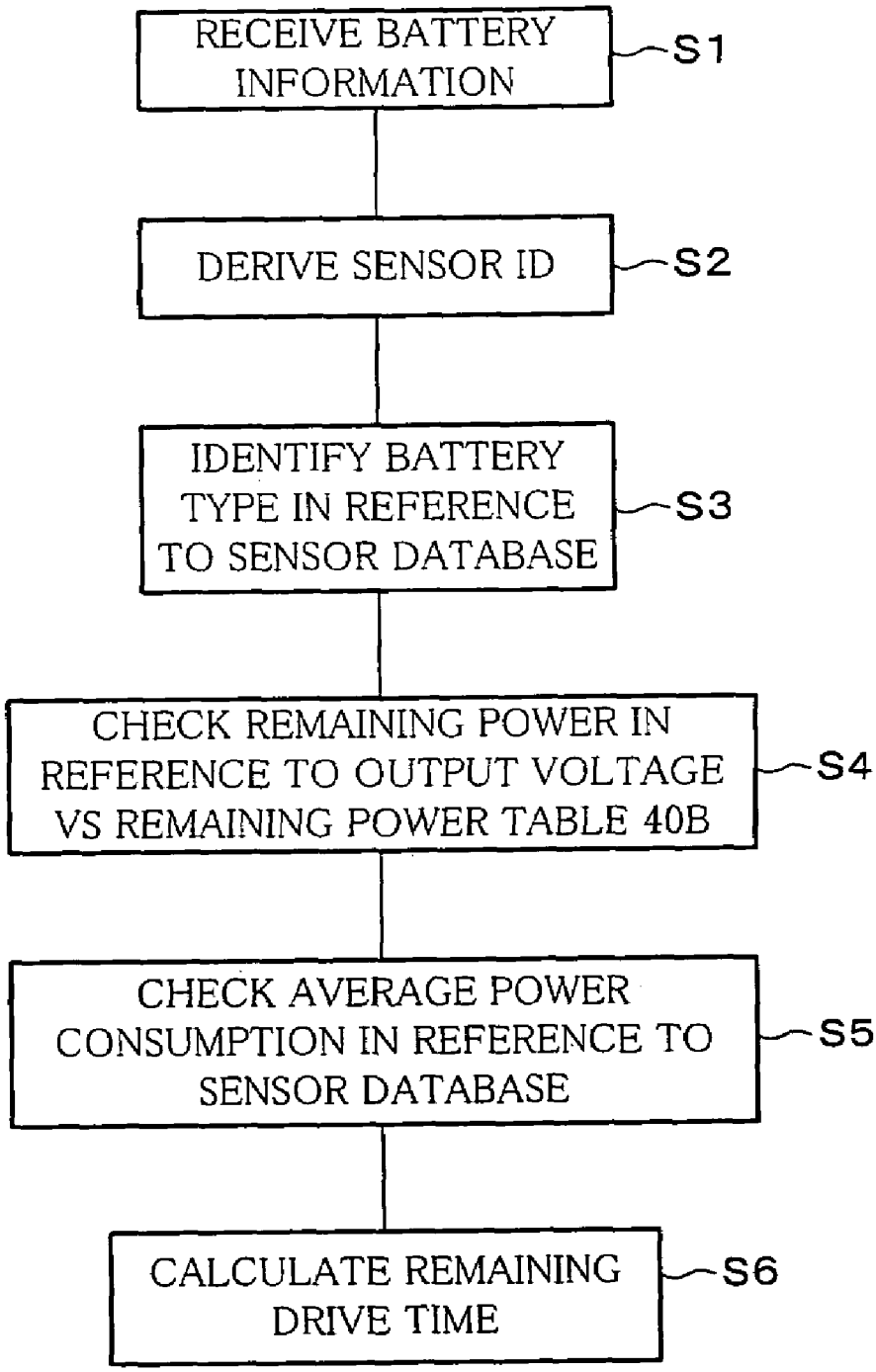
FIG. 7 is a flow chart showing a process flow in calculating estimated remaining battery power and remaining drive time.

The process flow is now explained with reference to the flow chart in FIG. 7. First, in step 1 ("S1"), upon reception of battery information from one of the sensors 5 via the input/output processing section 34, the drive time control section 37 derives the sensor ID from its header (S2). By referring to the sensor database 40*a*, the type of battery used in the sensor 5 from which the battery information has been received is checked (S3). Thereafter, referring to the output voltage vs. remaining power tables 40*b*, the remaining power is checked on the basis of information on the output voltage (S4). Then, by referring to the sensor database 40*a*, the average power consumption for the sensor 5 is determined (S5). The remaining drive time of the sensor 5 is calculated on the basis of the remaining power and the average power consumption (S6).

Next will be described the process of calculating a control method for the operation status of the battery-driven sensor 5 carried out by the drive time control section 37 in accordance with the remaining drive time.

In the case of a system where multiple battery-driven sensors 5 are installed as in the sensor network system in accordance with the present embodiment, when one of the sensors 5 runs out of battery power, a maintenance work is required to recharge the sensor 5. The sensors 5 vary in battery capacity and power consumption, therefore running out of battery power at different times from one sensor 5 to another. Under these circumstances, the batteries must be frequently recharged, which adds to the maintenance workload for the sensor network system manager.

Accordingly, in the present embodiment, the sensors 5 are made to have substantially equal remaining drive times by controlling the operation status of the sensors 5 in accordance with the remaining battery power of the sensors 5. Thus, the batteries in many of the sensors 5 can be recharged in a single round of maintenance work, making it possible to greatly reduce the frequency of performing recharging. Here, with a target value for the remaining drive time being termed a target remaining drive time, the above control can be described as controlling the operation of the sensor 5 to make the remaining drive time of the sensor 5 equal to the target remaining drive time. The following will describe this control method in more detail.

First, the target remaining drive time is defined as follows: The remaining drive times of those one of the sensors 5 in the sensor network system which are the control targets as to remaining drive time are, as mentioned earlier, recorded in the sensor database 40*a*. Accordingly, the drive time control section 37 derives the longest remaining drive time at a certain point in time from the remaining drive times of the sensors 5 recorded in the sensor database 40*a*. The drive time control section 37 then set the target remaining drive time to the longest remaining drive time and stores it in the memory section 32. The target remaining drive time, as will be detailed later, is suitably modified in accordance with the operation status of the sensors 5.

Major specific control techniques for sensors 5 are: control of (i) sense times, (ii) the number of sensing reports, (iii) wireless outputs, (iv) operational temperatures, and (v) drive power.

First, the control of (i) sense times will be described. The sensors 5 vary in time in which they actually perform sensing (sense time), depending on their sense targets and sensing operations. The sensors 5 are roughly divided into two categories: the "continuous type" which continuously perform sensing operation throughout a specified period of time and the "cyclic type" which temporarily performs sensing operation at a specified cycle. Examples of the continuous type include sensors which perform sensing around the clock, at specified times of the day, and at specified times which may vary from one day of the week to the other. Examples of the cyclic types include sensors which manage the sense cycles by themselves and which perform sensing under instructions from the server 2. A cyclic sensor may, for example, be controlled so that the operation period for a single round of sensing operation performed at a specified cycle is set to a predetermined value, and data obtained from sensing during the operation period is average and sent to the server 2.

A continuous type of sensor is capable of extending the remaining drive time, hence bringing it closer to the target remaining drive time, by cutting short the default sense time setting. The cyclic type of sensor is capable of extending the remaining drive time, hence bringing it closer to the target remaining drive time, by cutting short the default operation period setting for a single round of sensing operation.

Next, the control of (ii) the number of sensing reports will be described. The sensors 5 controlled by this technique are cyclic. Cyclic sensors 5, as mentioned above, temporarily perform sensing operation at a specified cycle. The cyclic sensor 5 is capable of extending the remaining drive time, hence bringing it closer to the target remaining drive time, by either reducing the frequency of the sensing operation and/or reducing the frequency of sending a sensing result to the server 2.

Next, the control of (iii) wireless outputs will be described. The sensors 5 controlled by this technique are those wireless-transferring sensing results to the sensor network controller 4. Some wireless communications sensors 5, as shown in FIG. 3, belong to two or more sensor networks 1 and can communicate with more than one sensor network controller 4. Under these situations, the wireless output range is set to reach the farthest one of the communicable sensor network controllers 4 or the one which is least reachable by radio waves. Accordingly, by lowering the wireless output to such an extent that there is at least one communicable sensor network controller 4, the remaining drive time is extendable and brought closer to the target remaining drive time.

Next, the control of (iv) operational temperatures will be described. The sensors 5 controlled by this technique consume increasing electric power at high temperatures due to the temperature dependence of resistance values and chemical battery. The sensor 5 of this type is capable of extending the remaining drive time, hence bringing it closer to the target remaining drive time, by suspending operation when ambient temperature is higher than or equal to a predetermined value.

Next, the control of (v) drive power will be described. The sensors 5 controlled by this technique are capable of increasing/decreasing their drive power needed for sensing operation. An example is an intrusion sensor detecting an intruding object by means of emission of electromagnetic waves, for example, millimeter waves or microwaves. The intrusion sensor has a sensor range which increases with increasing electromagnetic wave output and which conversely decreases with decreasing electromagnetic wave output. In other words, the sensor is capable of extending the remaining drive time, hence bringing it closer to the target remaining drive time, by reducing the drive power and electromagnetic wave output.

The above description gave specific control techniques (i) to (v) for the sensors 5. Other operation control techniques of extending the remaining drive time of the sensors 5, if any, are also applicable.

As in the foregoing, to extend the remaining drive time of the sensors 5, the drive time control section 37 restrains, rather than enhances, the various operations of the sensors 5. Specifically, an operation control quantity is calculated in the following manner.

Suppose that the sensor database 40*a* contains a table of records of the relationship between operation control quantities for each operation type and average power consumption for the operation control quantities. A target average power consumption by which a target remaining drive time is achieved is calculated from the remaining power and target remaining drive time of the sensor 5. Specifically, the calculation is based on (Target Average Power Consumption)=(Remaining Power/Target Remaining Time). The operation control quantity which produces the average power consumption closest to the target average power consumption is identified in reference to the sensor database 40*a*.

Under these circumstances, if the various operations of the sensors 5 are restrained more than necessary to extend the remaining drive time, the remaining drive time is extended indeed; however, required sensing operation may not be achieved.

Accordingly, the sensor database 40*a* contains a minimum operation control value indicating the lower limit of an operation parameter at which the operation of the sensors 5 can be controlled. For example, in the case of the control of (i) sense times, the sensor database 40*a* contains minimum values of the required sense times for the sensors 5 as minimum operation control value. If the operation control quantity required to realize the target remaining drive time is below the minimum operation control value, the operation control is performed based on the minimum operation control value. A remaining drive time is calculated based on that operation control to set the target remaining drive time to the calculated remaining drive time.

The calculation of the target remaining drive time is carried out as follows: First, the sensor database 40*a* contains the average power consumption when the sensor 5 is set to work based on the minimum operation control value. The drive time control section 37 retrieves the average power consumption for the sensor 5 from the sensor database 40*a*, and checks the remaining power of the sensor 5. Then, the drive time control section 37 calculates the remaining drive time given by: (Remaining Drive Time)=(Remaining Power)/(Average Power Consumption). The target remaining drive time is set to the calculated remaining drive time.

Figure 1:
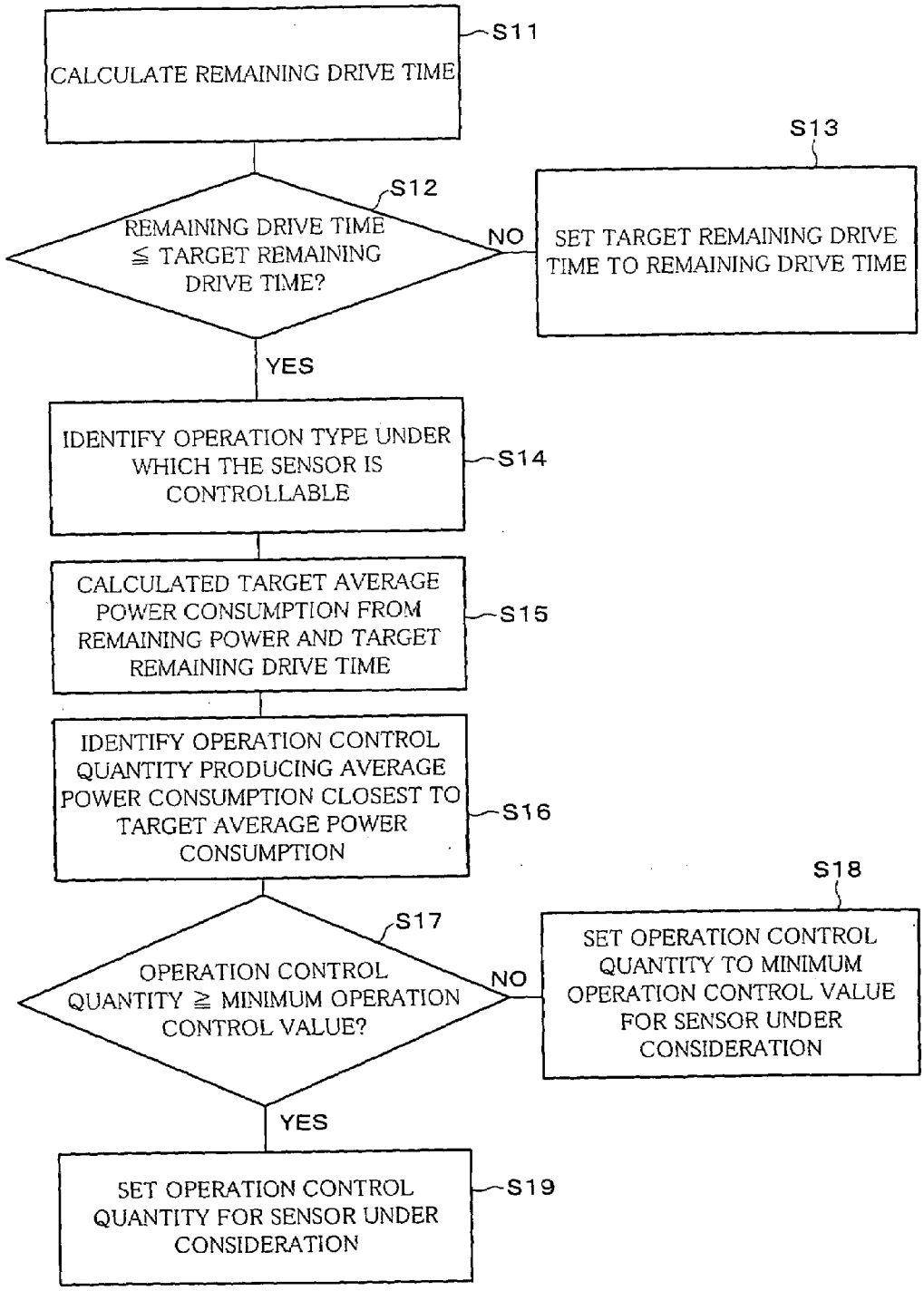
FIG. 1 is a flow chart showing a process flow in specifying an operation control quantity for a given sensor in a sensor network system in accordance with an embodiment of the present invention.

The process of specifying the operation control quantity for the sensor 5 as implemented by the drive time control section 37 will be now described in reference to the flow chart in FIG. 1 as a summary of the discussion above. First, in S11, the remaining drive time for the sensor 5 is calculated by the process illustrated in the FIG. 7 flow chart detailed earlier. It is then determined whether or not the remaining drive time is less than or equal to the target remaining drive time calculated by the aforementioned method (S12).

If the answer is NO in S12, that is, if the remaining drive time is determined to be greater than the target remaining drive time, the target remaining drive time is set to this new remaining drive time (S13), registering the setting in the memory section 32. The current operation control quantity is applied without change to the sensor 5.

In contrast, if the answer is YES in S12, that is, if the remaining drive time is determined to be less than or equal to the target remaining drive time, the operation type under which the sensor is operable is identified by referring to the sensor database 40*a* (S14). Thereafter, a target average power consumption is calculated from the remaining power and the target remaining drive time for the sensor 5 according to the aforementioned evaluation equation (S15). The calculated target average power consumption is compared with the average power consumption for the operation control quantities contained in the sensor database 40*a* to identify the operation control quantity which produces the average power consumption closest to the target average power consumption (S16).

It is then determined whether the operation control quantity identified in S16 is greater than or equal to the minimum operation control value contained in the sensor database 40*a* (S17). If the operation control quantity is determined to be smaller than the minimum operation control value (NO in S17), the operation control quantity is set to the minimum operation control value for the sensor 5, and the sensor 5 is notified of the new setting and instructed (S18). In contrast, if operation control quantity is determined to be more than or equal to the minimum operation control value (YES in S17), the operation control quantity is set to this operation control quantity for the sensor 5, and the sensor 5 is notified of the new setting and instructed (S19).

Possibly, some of the sensors 5 may be meaningless unless they operate based on the default operation control quantity setting. In other words, these sensors are important and their operation cannot be scaled down. These sensors are registered as an exception in the foregoing operation control application in the sensor database 40*a*.

The present embodiment assumes that the drive time control section 37 is provided in the server 3. This is not the only possibility. The drive time control section 37 may be provided in another communication terminal or the communications network controller 4.

EMBODIMENT 2

Figure 8:
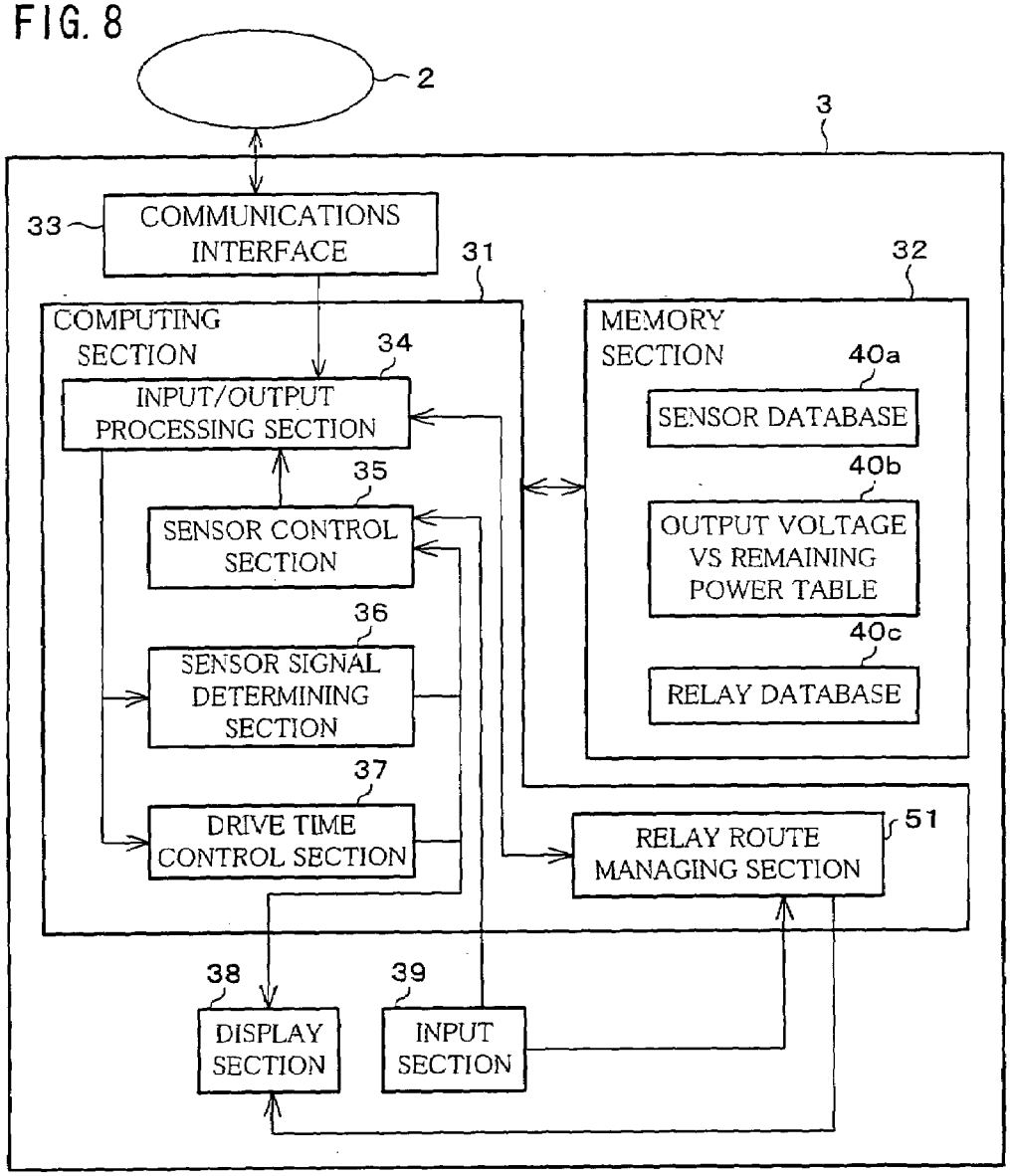
FIG. 8 is a schematic block diagram illustrating a configuration of a server in accordance with another embodiment of the present invention.
Figure 9:
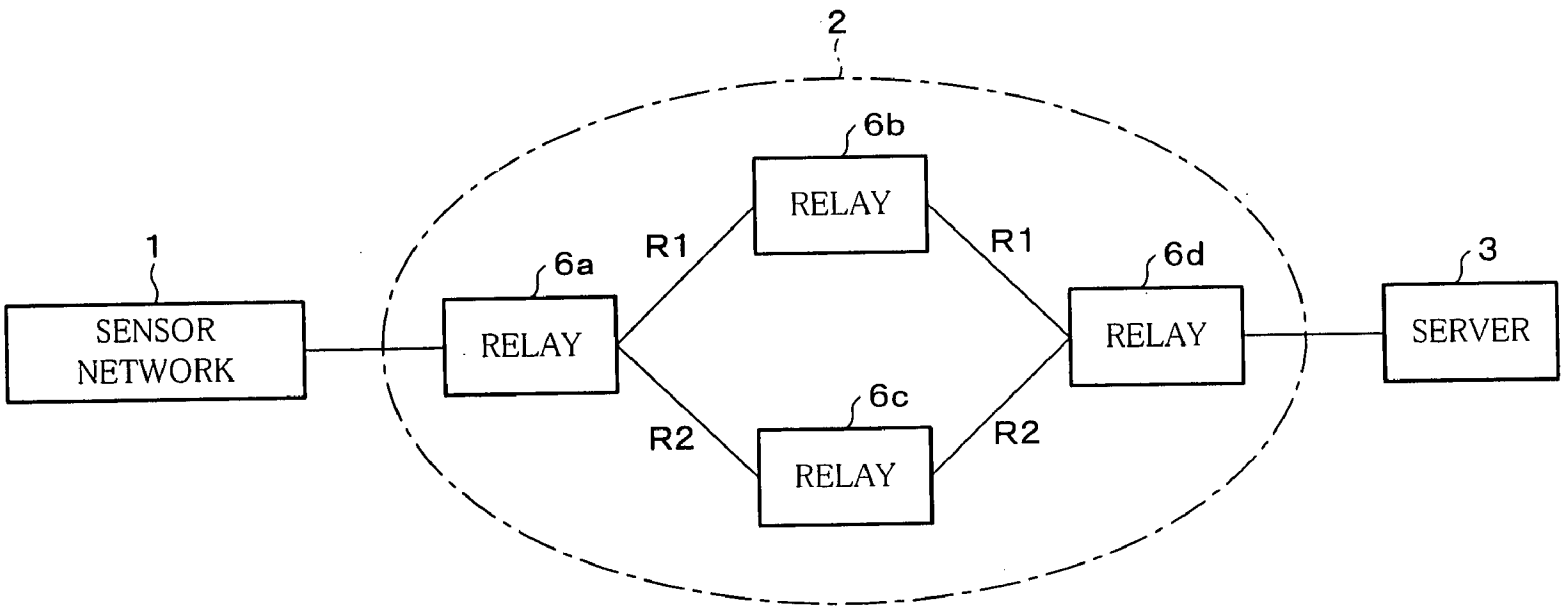
FIG. 9 is a drawing explaining an example of relay routes in a relay network.
Figure 10:
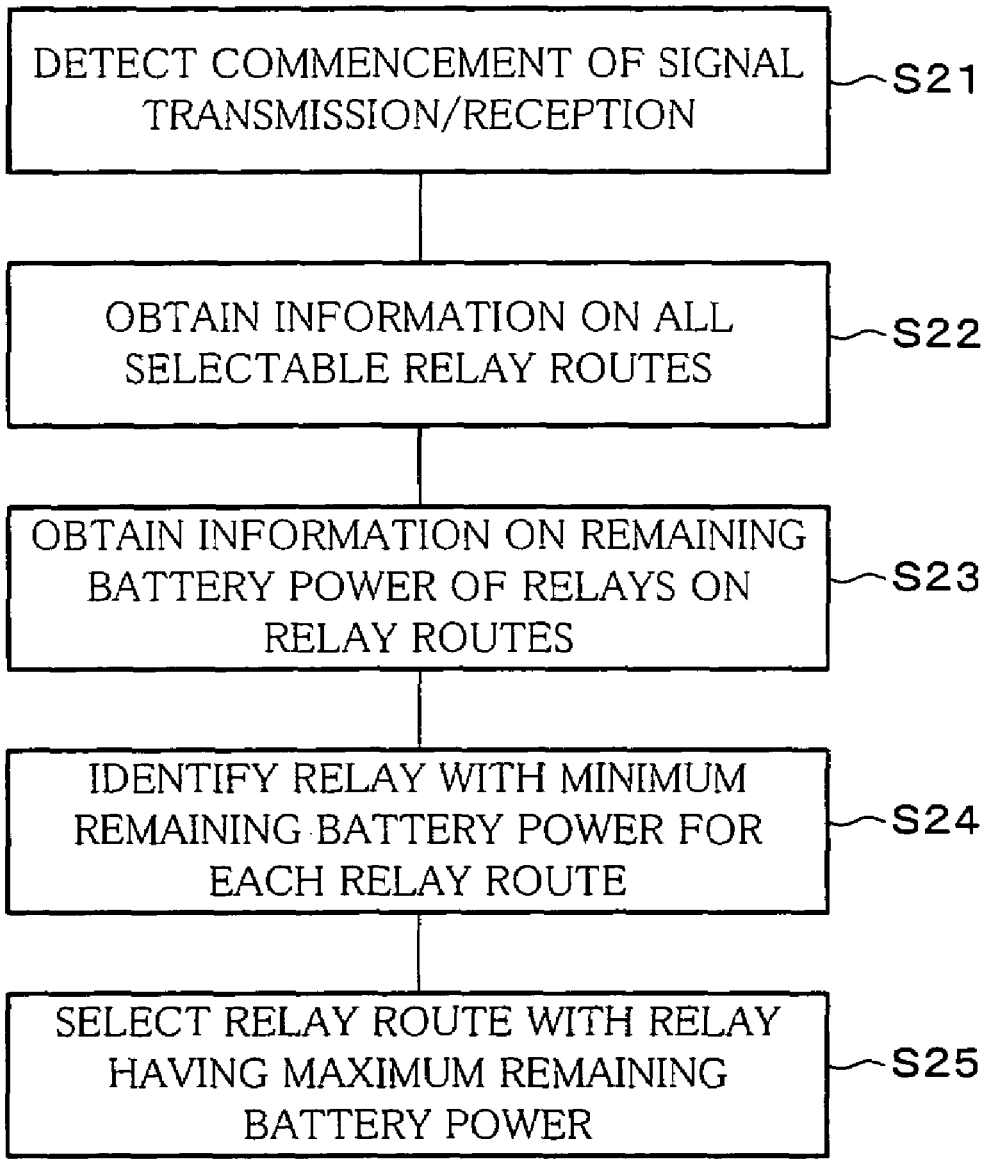
FIG. 10 is a flow chart showing a process flow in a relay route managing section.

The following will describe another embodiment of the present invention in reference to FIG. 8 through FIG. 10. Here, for convenience, members of the present embodiment that have the same arrangement and function as members of embodiment 1, and that are mentioned in that embodiment are indicated by the same reference numerals and description thereof is omitted.

A sensor network system in accordance with the present embodiment is capable of controlling relay routes in a relay network 2, as well as the functions of the sensor network system in accordance with embodiment 1. The sensor network system in accordance with the present embodiment is arranged similarly to the arrangement described in embodiment 1 with reference to FIG. 2. Differences lie in the configuration of a server 3 which will be detailed later.

In a sensor network system in accordance with the present embodiment, the relay network 2 is composed of a set of relays 6, working as a relay enabling data transmission/reception between the server 3 and the sensor network 1. Some of the relays 6 may rely on external power supply, and under certain setup conditions where it is difficult to provide external power supply, operate from batteries.

Communications routes in the relay network 2 are changed greatly based on, for example, the positional relationship between the server 3 and a sensor network controller 4 transmitting/receiving data to/from the server 3. As mentioned earlier, each relay 6 is communicable with at least one other relay 6; therefore, more than one communications route exist between the server 3 and a particular sensor network controller 4.

In such a system, particular relays 6 may be used at an extremely high frequency, depending on the method of selecting a communications route. If the particular relays 6 operate from batteries, they run out of battery power quickly, and the batteries need to be frequently recharged. This means added frequency of maintenance recharging and an added workload for the sensor network system manager. Another problem is that an extremely frequent use of the relays 6 shortens the service life of the relays 6 and its batteries.

Accordingly, in the present invention, the relays 6 are made to be used at equal frequency by controlling the relay route in the relay network 2 to select relays 6 used for relay operation. Thus, the foregoing adverse effects from a frequent use of particular relays 6 can be avoided.

The present embodiment assumes that the battery-driven relays 6 convey battery information to the server 3, for example, periodically. This battery information is similar to the battery information outputs from the sensors 5 in embodiment 1. The following will describe the control method in detail.

First, relay routes in the relay network 2 will be briefly described with reference to FIG. 9. The relay network 2 is constituted by four relays 6*a*, 6*b*, 6*c*, 6*d* as an example as shown in FIG. 9. A sensor network 1 is only communicable with the relay 6*a*. The server 3 is only communicable with the relay 6*d*.

In the relay network 2, the relay 6*a* is only communicable with the relays 6*b*, 6*c*. The relay 6*d* is only communicable with the relays 6*b*, 6*c*. For communications between the sensor network 1 and the server 3, there exist a route R1 linking the relays 6*a*–6*b*–6*d* and a route R2 linking the relays 6*a*–6*c*–6*d*.

Let us assume here that, for example, the relays 6*b* is about to run out of battery power. If the route R2 is used for communications between the sensor network 1 and the server 3, the relay 6*b* does not need to be involved in the relay operation, refraining from consuming its battery power. Control of relay routes in accordance with the present embodiment will be described below.

FIG. 8 is a schematic block diagram illustrating a configuration of the server 3 in accordance with the present embodiment. The server 3 differs from the server 3 shown in FIG. 5 in that the former has a relay route managing section 51 and in the computing section 31 and a relay database 40*c* in the memory section 32. The two servers 3 are otherwise identical.

The relay route managing section 51 transmits, to the relays 6 in the relay network 2 through an input/output processing section 34 and a communications interface 33, a signal used to specify an optimal relay route on the basis of the incoming battery information from the relays 6 through the communications interface 33 and the input/output processing section 34 and to establish the specified relay route. The contents of the process implemented by the relay route managing section 51 are displayed on the display section 38 in a suitable manner, and the settings of the process are alterable in a suitable manner through operator inputs at the input section 39.

The relay database 40*c* is a database recording information on all the relays 6 in the relay network 2. The following will present some examples of information on the relays 6.

A first example is information on the locations of the relays 6. More specifically, the information represents the geographical area where the relays 6 are installed (place name or latitude/longitude) and their installation scheme (on the ground, in the air, on a wall, height above the ground).

A next example is information as to whether the relays 6 operate from a battery or not. For battery-driven relays 6, the type of battery used as the battery, an average power consumption by the relays 6 for relay operation, and other information are recorded in the relay database 40*c*.

A next example is information on relays 6 with which the individual relays 6 can communicate. Here, information on the distance to other communicable relays 6 is also recorded.

These kinds of information is recorded for each relay 6 in the relay database 40*c*. It is assumed that the relays 6 are identifiable by relay IDs and that the battery signal sent to the server 3 contains a relay ID in the header.

Also, the relay database 40*c* contains information on all selectable relay routes for all the sensor network controllers 4 on the sensor network system.

Next, a process flow in the relay route managing section 51 will be described in reference to the flow chart in FIG. 10. First, in S21, an occurrence is detected of a need for a signal transmission/reception between the server 3 and a particular sensor network controller 4. The need is regarded as having occurred when, for example, an implementation is detected of an initial signal sequence which indicates a start of a signal transmission/reception. The relay route for the initial signal sequence is previously determined.

Next, information on all selectable relay routes to the sensor network controller 4 is obtained through an enquiry to the relay database 40*c* (S22). Information on the remaining battery power of the relays 6 on the relay routes is obtained through an enquiry to the relay database 40*c* (S23).

Thereafter, a relay 6 with a minimum remaining battery power is identified for each relay route (S24). Of those relays 6 with a minimum remaining battery power for the individual relay routes, the relay route on which is located a relay 6 with a maximum remaining battery power is selected and designated as the relay route for the signal transmission/reception (S25).

In this example, the relay database 40*c* contains information on all the selectable relay routes for all the sensor network controllers 4 in the sensor network system. However, the relay database 40*c* does not necessarily contain the information; the relay route managing section 51 may instead identify through calculation a selectable relay route for the sensor network controller 4 in a relay route select process. The calculation is possible if the relay route managing section 51 retrieves from the relay database 40*c* information on which relay 6 is communicable with which relays 6.

The present embodiment assumes that the relay route managing section is provided in the server 3. This is not the only possibility. The relay route managing section may be provided in another communication terminal.

(Operation and Effects of the Present Invention)

As in the foregoing, a sensor network system managing method in accordance with the present invention is implemented by a sensor network system managing device, communicable with sensors, which receives sensor information from the sensors and controls operation of the sensors, and involves the steps of: acquiring remaining drive times of batteries in the sensors; specifying a target remaining drive time; and controlling the operation of the sensors so that the remaining drive times of the batteries in the sensors are substantially equal to the target remaining drive time.

Another sensor network system managing method in accordance with the present invention may be arranged, in the foregoing method, so that the target remaining drive time is set to the remaining drive time of a battery in a sensor of which the battery has the longest remaining drive time at the time.

According to the method, the target remaining drive time is set to the remaining drive time of a battery in a sensor of which the battery has the longest remaining drive time; therefore, the operation of the other sensors is controlled so as to extend the remaining drive times of the batteries. The sensors can thus operate longer before they need recharging. Recharge frequency and maintenance workloads are both reduced.

Another sensor network system managing method in accordance with the present invention may be arranged, in the foregoing method, so that: remaining battery power is detected; a target average power consumption is calculated from the remaining power and the target remaining drive time; and the operation of the sensor is controlled so as to achieve the target average power consumption.

According to the method, first, the remaining battery power of a sensor is detected. A target average power consumption is calculated from the remaining power and the target remaining drive time. Having determined the target average power consumption in this manner, it is understood how the sensors should be operated to achieve the target remaining drive time. It is therefore appropriately understood how the operation of the sensors should be controlled.

Another sensor network system managing method in accordance with the present invention may be arranged, in the foregoing method, so that a minimum operation control value at which a minimum level of functions is achieved is specified in advance for each sensor; and the operation of the sensors is controlled so as not to fall below the minimum operation control value.

According to the method, first, a minimum operation control value at which a minimum level of functions is achieved is specified for each sensor. The minimum operation control value indicates nothing but the lower limit value of an operation quantity for a sensor. In the case of an actually operation parameter, the minimum operation control value may be a maximum value; For example, if the operation parameter is the interval of reports being made on sensing operation, a maximum value of the report interval is the minimum operation control value.

If the operation control quantity required to achieve the target remaining drive time is below the minimum operation control value, the sensor is controlled based on the minimum operation control value. This prevents the sensor from becoming incapable of necessary sensing operation in mere consideration of achieving the target remaining drive time. In other words, this ensures a minimum level of operation required of the sensor.

Note that "the operation of the sensors is controlled so as not to fall below the minimum operation control value" means that the operation quantity does not fall below the lower limit. In the case of an actually operation parameter, the operation quantity may be specified not to exceed a maximum value as the minimum operation control value.

A sensor network system managing program in accordance with the present invention causes a computer to implement the sensor network system managing method in accordance with the present invention.

A storage medium containing a sensor network system managing program in accordance with the present invention is arranged to contain a sensor network system managing program causing a computer to implement the sensor network system managing method in accordance with the present invention.

By loading the computer program or a computer program contained in the storage medium into a computer system, the sensor network system managing method is provided to the user.

Another sensor network system managing device in accordance with the present invention is communicable with sensors, receives sensor information from the sensors, and controls operation of the sensors, and is arranged to include a drive time control section calculating operation control quantities for the sensors based on information on batteries supplied by the sensors, wherein the drive time control section implements the sensor network system managing method in accordance with the present invention.

According to the arrangement there is provided a drive time control section implementing the sensor network system managing method. As mentioned earlier, This enables recharging of many sensor batteries in a single round of recharge maintenance work, thereby greatly reducing recharge frequency. Therefore, a manager managing the sensor network system is relieved of some of the maintenance workloads.

A relay network managing method in accordance with the present invention communicably links communication terminals with each other through relays interconnected in a communicable manner, and is characterized by involving the steps of:

acquiring selectable relay routes when two specific communication terminals communicate with each other;

acquiring information on remaining battery power of relays located on the selectable relay routes;

identifying a relay, for each relay route, which has a minimum remaining battery power on that relay route; and selecting one of the relay routes on which is located a relay with a maximum remaining battery power among those relays which have a minimum remaining battery power on the individual relay routes, and specifying as a relay route for a signal transmission/reception between the two specific communication terminals.

Another relay network managing method in accordance with the present invention may be arranged, in the foregoing method, so that the communication terminals are sensors and a sensor network system managing device receiving sensor information from the sensors and controlling operation of the sensors.

According to the method, the invention is applied to a sensor network system including sensors and a sensor network system managing device managing these sensors. In such sensor network systems, sensors are installed in so great a variety of places that the sensors are in many cases relatively far from the sensor network system managing device. In these cases, a relay network such as the foregoing one is needed to provide a communicable link between the sensors and the sensor network system managing device. In these relay networks, the relays are in many cases located so far from each other that maintenance work to recharge relay batteries requires relatively a lot of labor. Here, reducing recharge frequency as in the foregoing method relieves a system manager of many of the workloads.

A relay network managing program in accordance with the present invention causes a computer to implement the relay network managing method in accordance with the present invention.

A storage medium containing a relay network managing program in accordance with the present invention is arranged to contain a relay network managing program causing a computer to implement a relay network managing method in accordance with the present invention.

By loading the computer program or a computer program contained in the storage medium into a computer system, the relay network managing method is provided to the user.

A relay network managing device in accordance with the present invention manages a relay network communicably linking communication terminals with each other through relays interconnected in a communicable manner, and is arranged to include a relay route managing section specifying a relay route in the relay network based on information on batteries supplied by the relays, wherein the relay route managing section implements the relay network managing method in accordance with the present invention.

According to the arrangement, there is provided a relay route managing section implementing the relay network managing method; therefore, as mentioned earlier, an inconvenience is prevented from happening where particular relays were so frequently used that they could quickly run out of battery and require frequent recharging. The system manager is relieved of some of the workloads.

The embodiments and examples described in BEST MODE FOR CARRYING OUT THE INVENTION are for illustrative purposes only and by no means limit the scope of the present invention. Variations are not to be regarded as a departure from the spirit and scope of the invention, and all such modifications as would be obvious to one skilled in the art are intended to be included within the scope of the claims below.

INDUSTRIAL APPLICABILITY

The sensor network system in accordance with the present invention is applicable to sensor network systems including a set of sensor networks of a great variety of sensors for objectives like detecting car thefts, house break-ins, and fires.

The invention claimed is:

1. A sensor network system managing method implemented by a sensor network system managing device communicable with sensors, said device receiving sensor information from the sensors and controlling operation of the sensors, said method characterized in that by comprising the steps of:

acquiring remaining drive times of batteries in the sensors;

specifying a target remaining drive time; and controlling the operation of the sensors so that the remaining drive times of the batteries in the sensors are substantially equal to the target remaining drive time.

2. The sensor network system managing method as defined in claim 1, wherein the target remaining drive time is set to a remaining drive time of a battery in a sensor of which the battery has the longest remaining drive time at the time.

3. The sensor network system managing method as defined in claim 1, wherein:

remaining battery power is detected; and a target average power consumption is calculated from the remaining power and the target remaining drive time; and the operation of the sensor is controlled so as to achieve the target average power consumption.

4. The sensor network system managing method as defined in claim 1 wherein:

a minimum operation control value at which a minimum level of functions is achieved is specified in advance for each sensor; and the operation of the sensors is controlled so as not to fall below the minimum operation control value.

5. A sensor network system managing program causing a computer to implement the sensor network system managing method as defined in claim 1.

6. A storage medium containing a sensor network system managing program causing a computer to implement the sensor network system managing method as defined in claim 1.

7. A sensor network system managing device communicable with sensors, said device receiving sensor information from the sensors and controlling operation of the sensors, said device characterized in that by comprising:

a drive time control section calculating operation control quantities for the sensors based on information on batteries supplied by the sensors, wherein the drive time control section implements the sensor network system managing method as defined in claim 1.

8. A relay network managing method of communicably linking communication terminals with each other through relays interconnected in a communicable manner, said method characterized by comprising the steps of:

acquiring selectable relay routes when two specific communication terminals communicate with each other;

acquiring information on remaining battery power of relays located on the selectable relay routes;

identifying a relay, for each relay route, which has a minimum remaining battery power on that relay route;

selecting one of the relay routes to which is located a relay with a maximum remaining battery power among those relays which have a minimum remaining battery power on the individual relay routes; and specifying as a relay route for a signal transmission/reception between the two specific communication terminals, wherein the communication terminals are sensors and a sensor network system managing device receiving sensor information from the sensors and controlling operation of the sensors.

9. A relay network managing program causing a computer to implement the relay network managing method as defined in claim 8.

10. A storage medium containing a relay network managing program causing a computer to implement the relay network managing method as defined in claim 8.

11. A relay network managing device managing a relay network communicably linking communication terminals with each other through relays interconnected in a communicable manner, said device characterized by comprising a relay route managing section specifying a relay route in the relay network based on information on batteries supplied by the relays, wherein the relay route managing section implements the relay network managing method as defined in claim 8.

* * * * *